US008517484B2

(12) United States Patent
Eckartsberg et al.

(10) Patent No.: US 8,517,484 B2
(45) Date of Patent: Aug. 27, 2013

(54) ICE/LIQUID DISPENSING BAY

(75) Inventors: Peter Eckartsberg, Aalen (DE); Frank Placke, Gütersloh (DE); Ulrich van Pels, Rheda-Wiedenbrück (DE)

(73) Assignees: BSH Bosch und Siemens Hausgeraete GmbH, Munich (DE); Miele & Cie. KG, Gütersloh (DE)

( * ) Notice: Subject to any disclaimer, the term of this patent is extended or adjusted under 35 U.S.C. 154(b) by 300 days.

(21) Appl. No.: 12/996,982

(22) PCT Filed: Jun. 16, 2009

(86) PCT No.: PCT/EP2009/057400
§ 371 (c)(1),
(2), (4) Date: Dec. 9, 2010

(87) PCT Pub. No.: WO2010/003767
PCT Pub. Date: Jan. 14, 2010

(65) Prior Publication Data

US 2011/0083463 A1 Apr. 14, 2011

(30) Foreign Application Priority Data

Jun. 16, 2008 (DE) ..... 10 2008 028 585

(51) Int. Cl.
*A47B 96/04* (2006.01)

(52) U.S. Cl.
USPC ..... 312/405.1; 312/405; 312/319.1

(58) Field of Classification Search
USPC ..... 312/405.1, 401, 405, 209, 210, 210.5, 312/211, 212, 213, 228, 228.1, 229, 321.5, 312/140.4, 319.1; 62/389, 391; 222/108, 222/146.6; 206/77.1, 557; 220/571, 571.1, 220/172, 173, DIG. 6, 345.1, 345.2, 345.3, 220/345.4, 345.5, 796; 292/1, 288, DIG. 53, 292/DIG. 54, DIG. 71
See application file for complete search history.

(56) References Cited

U.S. PATENT DOCUMENTS

| | | | | |
|---|---|---|---|---|
| 4,527,707 | A * | 7/1985 | Heymann et al. | 220/571 |
| 4,759,466 | A * | 7/1988 | Chase et al. | 220/4.02 |
| 5,526,854 | A * | 6/1996 | Unger | 141/351 |
| 5,683,015 | A * | 11/1997 | Lee | 222/146.6 |
| 5,827,428 | A * | 10/1998 | Chang | 210/248 |
| 6,619,507 | B2 * | 9/2003 | Lassota | 222/108 |
| 7,007,500 | B2 * | 3/2006 | Lee | 62/389 |

(Continued)

FOREIGN PATENT DOCUMENTS

| | | |
|---|---|---|
| DE | 8634579 U1 | 6/1988 |
| GB | 2198512 A | 6/1988 |
| KR | 980004413 U | 3/1998 |
| KR | 10-2005-0077581 | 8/2005 |

*Primary Examiner* — Hanh V Tran
*Assistant Examiner* — Andres F Gallego
(74) *Attorney, Agent, or Firm* — James E. Howard; Andre Pallapies

(57) ABSTRACT

An ice/liquid dispensing bay for a domestic refrigeration device. The ice/liquid dispensing bay has a drip tray that defines a lower end of the bay and a drip plate that covers the drip tray. The drip plate has an edge with at least one locking recess into which a locking projection engages in a locked position. The locking projection is biased by a spring.

18 Claims, 3 Drawing Sheets

(56) References Cited

U.S. PATENT DOCUMENTS

| | | | | |
|---|---|---|---|---|
| 7,757,732 | B2 * | 7/2010 | Voglewede et al. | 141/360 |
| 2003/0196447 | A1 * | 10/2003 | Lee et al. | 62/389 |
| 2004/0182103 | A1 * | 9/2004 | Jung | 62/389 |
| 2004/0183414 | A1 * | 9/2004 | Kwon | 312/401 |
| 2005/0198991 | A1 * | 9/2005 | Harder et al. | 62/389 |
| 2007/0000944 | A1 * | 1/2007 | Cahen et al. | 222/108 |
| 2009/0095010 | A1 * | 4/2009 | Moon | 62/391 |
| 2009/0159154 | A1 * | 6/2009 | Buchstab et al. | 141/362 |
| 2010/0071401 | A1 * | 3/2010 | Jang et al. | 62/391 |
| 2011/0041542 | A1 * | 2/2011 | Brunner et al. | 62/344 |

* cited by examiner

ICE/LIQUID DISPENSING BAY

BACKGROUND OF THE INVENTION

The present invention relates to an ice/liquid dispensing bay for a domestic refrigeration device, comprising a drip tray defining a lower end of the bay and a drip plate covering the drip tray. It is particularly desirable to improve the operational reliability of such a bay.

BRIEF SUMMARY OF THE INVENTION

This object is inventively achieved for an ice/liquid dispensing bay of the type mentioned in the introduction by an edge of the drip plate (4) having at least one locking recess (25) into which a locking projection biased by a spring (9) engages in the locked position.

The stability of the drip plate is further improved if it has two locking recesses disposed as mirror images of one another on opposite edges.

The at least one locking recess is preferably constituted by a open-edge cutout on the edge of the drip plate.

As the circumferential edge of the drip plate engages at least in sections in a slot in the bay, it is retained in a non-tipping manner In order to achieve, with minimal material costs, a high degree of wear resistance for the repeatedly inserted and removed drip plate, the spring is preferably made of plastic, but the spring-loaded locking projection is a metal component.

The metal component is preferably retained in a pocket of the spring which extends transversely to the excursion direction of the spring. Therefore, when the locking projection is engaged and disengaged, restoring forces acting in the excursion direction of the spring cause no displacement or loosening of the metal component in the pocket.

The spring preferably comprises a displaceable first leg which delimits the slot accommodating the drip plate on at least one side. The spring therefore not only serves to lock the drip plate in the displacement direction, i.e. horizontally, but it at the same time limits the freedom of movement of the drip plate in the vertical direction.

An at least approximately U-shaped cross-section of the spring enables a particularly compact design to be implemented.

Of the two legs of the U-shaped cross-section, one leg preferably contains the locking projection, while the other leg is used to fasten the spring to the bay.

The spring is preferably protected and concealed from the user behind a back wall panel of the bay.

A lower edge of the back wall panel preferably defines the upper limit of the slot accommodating the drip plate.

The back wall panel is expediently curved in horizontal cross-section so that the drip plate can engage in the slot along as much of its edge as possible.

The lower limit of the slot accommodating the drip plate can be expediently defined by the drip tray itself.

The top of the drip tray can be provided with a grid supporting the drip plate.

The drip tray can preferably be removed from the bay to pour away the liquid collected therein, instead of having to wipe it out.

A lower end section of the bay preferably comprises a recess accommodating the drip tray, and a push-in mount for the spring. Such an end section concealed by the back wall panel and the drip plate during use can be inexpensively molded from plastic like the drip tray itself.

For mounting the spring, on the lower end section a pocket can be formed which accepts a fixed leg of the spring. The pocket can be formed in particular by two grooves facing one another, each accommodating a side edge of the fixed leg of the spring. In order not to impair the freedom of movement of the spring by the push-fit connection to the lower end section, the fixed leg of the spring is preferably wider than the elastically displaceable one, and the fixed leg's edges projecting in each case beyond the edge of the elastically displaceable leg engage in the grooves of the push-in mount.

Other developments of the invention are set forth in the sub-claims.

BRIEF DESCRIPTION OF THE DRAWINGS

Additional features and advantages of the invention and/or development will emerge from the following description of exemplary embodiments with reference to the accompanying drawings in which.

DETAILED DESCRIPTION OF EXEMPLARY EMBODIMENTS OF THE PRESENT INVENTION

Figure 1:
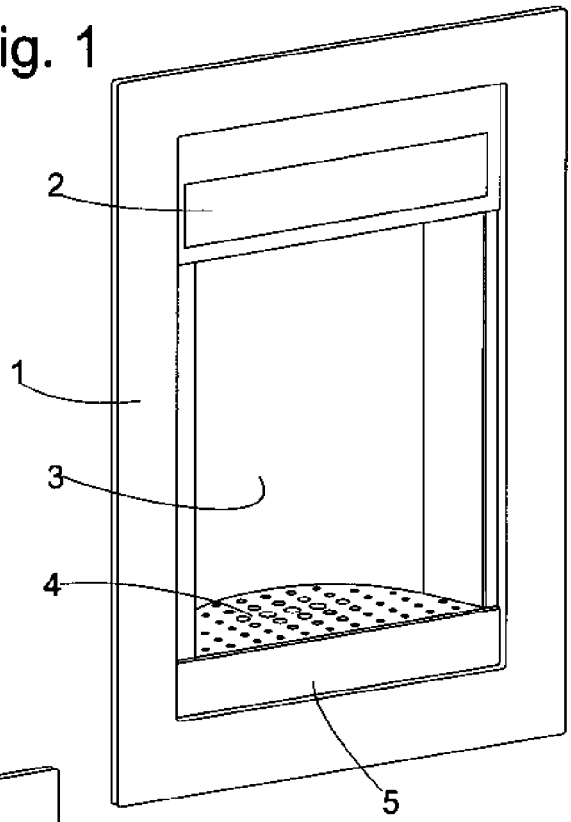
FIG. 1 shows a schematic view of an ice/water dispensing bay on a refrigeration device.

FIG. 1 shows a schematic view of an ice/water dispensing bay of a domestic refrigeration device. A window cut into the outer skin (not shown) of the appliance is concealed behind a rectangular frame 1 enclosing the bay. An upper region of the frame 1 is filled by a control panel 2 in which indicators and control buttons—not shown here—for the dispensing bay functions can be mounted. Behind the control panel 2, inside the bay, are outlet openings for the controlled dispensing of ice and chilled water.

Figure 3:
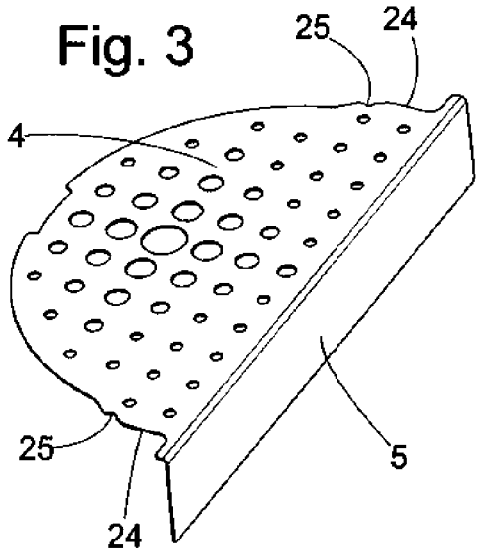
FIG. 3 shows a perspective view of the drip plate.

The visible back of the bay is clad with a back wall panel 3 bent in a trough-shaped manner. A stainless steel drip plate shown separately in FIG. 3 comprises a perforated horizontal drip plate 4 which forms the visible bottom of the bay during use, and a faceplate 5 integral with the drip plate 4 and filling up the lower region of the frame 1.

Figure 2:
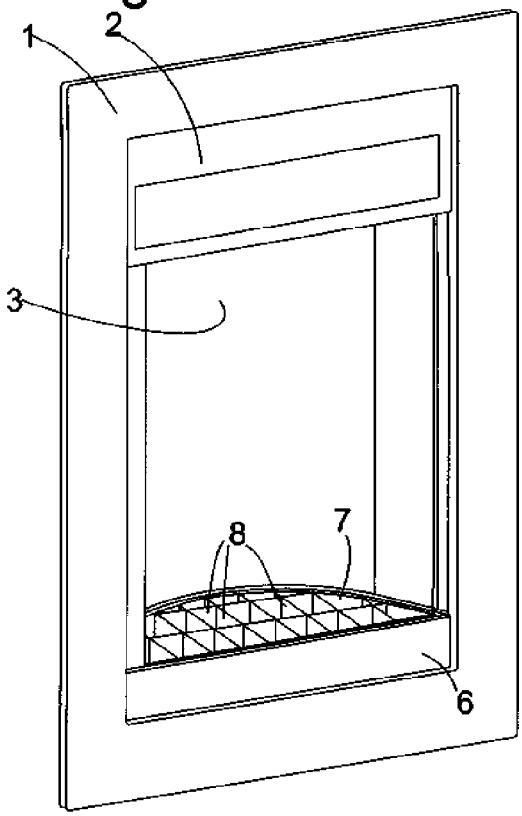
FIG. 2 shows the bay from FIG. 1 without drip plate.

The drip plate can be removed from the bay horizontally forward; the bay without the drip plate is shown in FIG. 2. When the drip plate is removed, a front edge of a plastic molded lower end section 6 of the bay, previously concealed by the faceplate 5, is visible. A drip tray 7 is loosely inserted in a recess of the lower end section 6 which is delimited by the front wall and upwardly open. Intersecting crosspieces 8 form a grid that is flush with the top edge of the drip tray 7. The crosspieces are in each open near the base of the drip tray 7 so that the compartments delimited by the crosspieces of the drip tray 7 intercommunicate.

Figure 4:
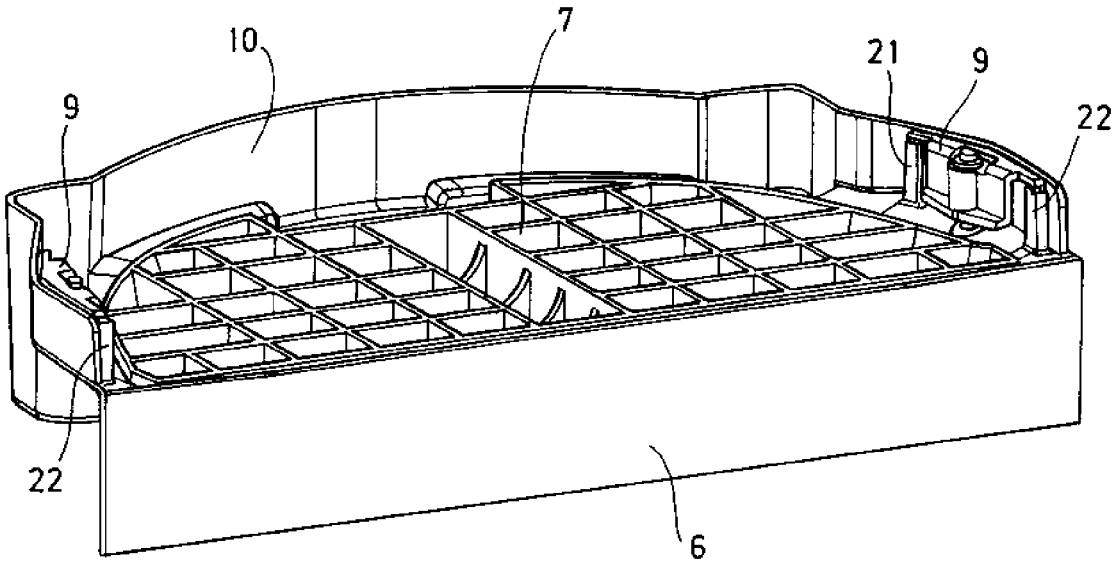
FIG. 4 shows a perspective view of the lower end section with drip tray accommodated therein and two springs attached thereto.

FIG. 4 shows a perspective view of the lower end section 6, the drip tray 7 and two springs 9 fixed to the lower end section 6.

As can be seen, the lower end section 6 has, extending upward beyond the drip tray 7, a curved back wall 10 which, in the assembled state, braces, in its central area, the back wall panel 3 against pressure forces acting into the bay. The lateral flanks of the back wall 10 run spaced apart from the back wall panel 3 (not shown in FIG. 4), and one of the above mentioned springs 9 is accommodated in the thus obtained interspace between the back wall 10 and the back wall panel 3.

Figure 5:
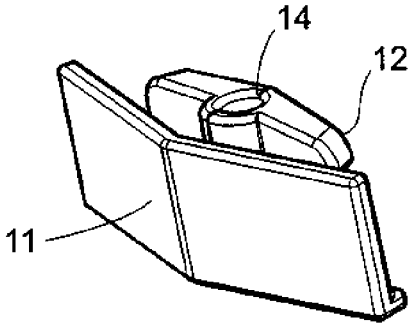
FIGS. 5 and 6 shows two perspective views of the springs from FIG. 3.
Figure 6:
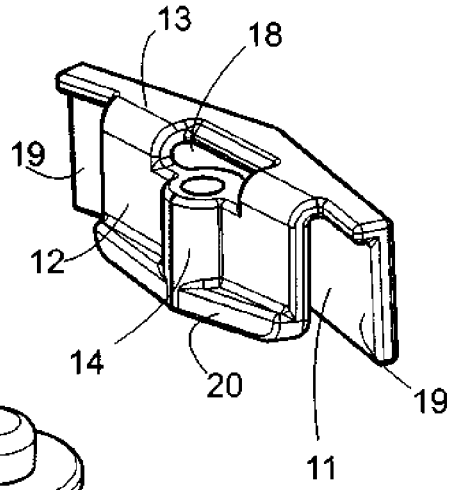
Figure 7:
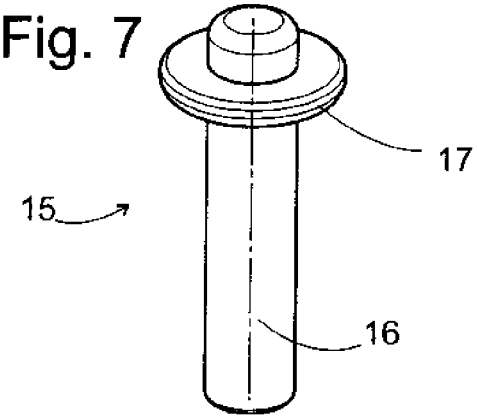
FIG. 7 shows a perspective view of a metal pin to be inserted in the spring in FIGS. 4 and 5.

The springs 9 are shown in detail in the perspective views of FIGS. 5 and 6. These are plastic moldings with a hairpin-like configuration in cross-section, having an outer leg 11 designed for fixed anchorage to the back wall 10, an elastically displaceable inner leg 12 and an elastically flexible bridge section 13 connecting the legs. The legs 11, 12 are themselves virtually inflexible; the outer leg 11 because of its two plate-shaped segments meeting in a roof-shaped manner at an obtuse angle; the inner 12 because it has a per se highly tubular section 14.

The tubular section 14 is provided in order to accommodate a preferably stainless steel metal pin 15 shown in FIG. 6. The metal pin 15 has a cylindrical section 16 which can be inserted in an essentially play-free manner in the tubular section 14, and a circumferential rim 17 which is dimensioned such that, when the metal pin 15 is inserted in the tubular section 14 from above, i.e. from the side of the bridge section 13, only the resistance passes the edge of a window 18 formed in the bridge section 13 adjacent to the tubular section 14 and latches into the window 18. The length of the cylindrical section 16 is designed such that its lower end protrudes from the tubular section 14 when the rim 17 is locked in the window 18.

The outer leg 11 is much wider than the inner leg 12 and has edge regions 19 extending beyond same on both sides. At its free end, the inner leg 12 is widened by angled supports 20 on both sides of the tubular section 14. As can be seen particularly in FIG. 4, the lower end of the inner leg 12 has no sharp corners, so that the drip plate 4 passes the springs 9 without catching on them when it is being inserted or removed.

Again referring to FIG. 4, the springs 9 are retained in the back wall 10 by a push-fit connection, in the form of two vertically elongated, hook-shaped profiles 21, 22 whose mutually facing grooves form an upwardly open insertion channel into which the outer leg 11 can be inserted, the projecting edge regions 19 of the outer leg 11 engaging in the grooves. As the profiles 21, 22 do not extend into the space between the legs 11, 12, they do not restrict the freedom of movement of the springs 9.

The tip of the metal pin 15 projects beyond the lower end of the inner leg 12.

Figure 8:
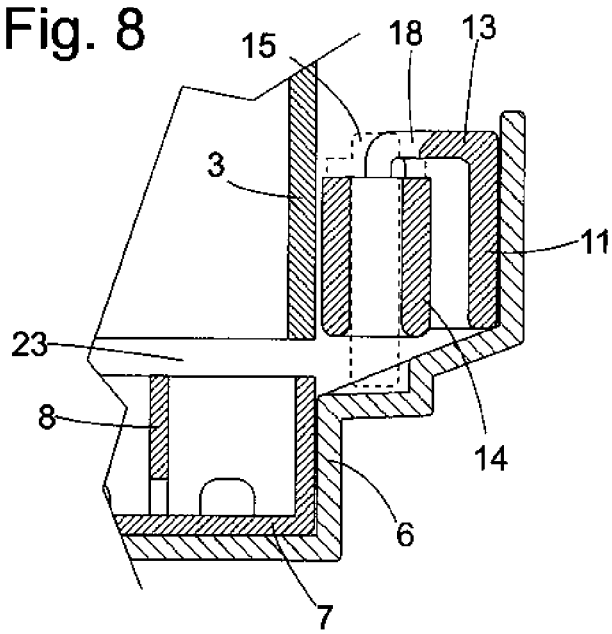
FIG. 8 shows a detail section through the dispensing bay in a plane running through one of the springs.

As shown more clearly in FIG. 8, the drip tray 7 and the curved back wall panel 3 and lower end of the inner leg 12 define the upper and lower limits of a horizontal slot 23 which is designed to accommodate the back edge of the drip plate 4. The lower end of the metal pin 15 shown as a dashed outline in FIG. 8 engages in said slot 23. The height of the slot 23 corresponds to the thickness of the drip plate 4 with minimal clearance.

Figure 9:
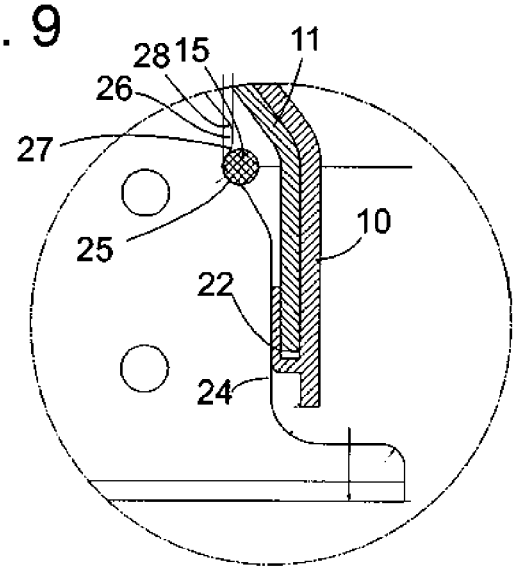
FIG. 9 shows an enlarged detail of the drip plate.

FIG. 9 shows an enlarged detail of the drip plate 4 mounted in the dispensing bay and the environment thereof. Parallel to its insertion direction, the drip plate 4 has two edge sections 24 (see also FIG. 3) which, in the assembled state, face the adjacent outer profile 22 with minimal clearance or are in contact therewith, as shown in FIG. 9. Due to the engagement in the slot 23 on the one hand and between the profiles 22 on the other, the drip plate 4 is precisely guided both vertically and horizontally crosswise with respect to the insertion direction.

Adjacent to the section 24 there is formed on the drip plate 4 an open-edge cutout 25 in which the metal pin 15 is engaged in the assembled state. A projection 26 bordering the cutout 25 deflects the metal pins 15 sideways when the drip plate 4 is inserted. The force required for engaging and disengaging the drip plate 4 can be defined by the shape of the projection, i.e. by its extent in the lateral direction and the orientation of its flanks 27, 28 relative to the insertion direction. The rubbing wear during engagement and disengagement of the drip plate 4 is low, as the rubbing parts forced against one another, namely the projection 26 and the pin 15, are both made of metal, particularly steel.

The invention claimed is:

1. An ice/liquid dispensing bay for a domestic refrigeration device, the ice/liquid dispensing bay comprising:

a drip tray defining a lower end of the bay; and a drip plate covering the drip tray, the drip plate having an edge that has at least one locking recess into which a locking projection that is biased by a spring engages in a locked position for securing the drip plate with the drip tray; wherein the spring includes a fixed leg that is mounted to the drip tray for attachment of the spring to the drip tray; the drip tray comprises a push-in mount for the spring;

a lower end section of the bay has a recess that accommodates the drip tray and the push-in mount; and the push-in mount comprises two facing grooves into which the fixed leg of the spring is inserted.

2. The ice/liquid dispensing bay of claim 1, wherein the drip plate has two locking recesses disposed on opposite edges.

3. The ice/liquid dispensing bay of claim 2, wherein the two locking recesses are disposed in a mirror-image manner on the drip plate.

4. The ice/liquid dispensing bay of claim 1, wherein the at least one locking recess is formed by an open-edge cutout on the edge of the drip plate.

5. The ice/liquid dispensing bay of claim 1, wherein a circumferential edge of the drip plate engages, at least in sections, in a slot in the bay.

6. The ice/liquid dispensing bay of claim 1, wherein the locking projection is a metal component fixed to the spring, and wherein the spring is made of plastic.

7. The ice/liquid dispensing bay of claim 6, wherein the metal component is retained in a pocket of the spring, and wherein the pocket extends in a lengthwise direction substantially perpendicular to a general direction of tension/bias created by the spring.

8. The ice/liquid dispensing bay of claim 1, wherein the spring comprises a displaceable first leg that is located substantially adjacent to a slot accommodating the edge of the drip plate.

9. The ice/liquid dispensing bay of claim 1, wherein the spring has an at least approximately U-shaped cross-section.

10. The ice/liquid dispensing bay of claim 9, wherein the U-shaped cross-section has two legs, and wherein a first leg of the two legs contains the locking projection and a second leg of the two legs is the fixed leg and fixes the spring to the bay.

11. The ice/liquid dispensing bay of claim 1, wherein the bay has a back wall panel, and wherein the spring is concealed behind the back wall panel.

12. The ice/liquid dispensing bay of claim 11, wherein a lower edge of the back wall panel defines an upper limit of a slot that accommodates the drip plate.

13. The ice/liquid dispensing bay of claim 11, wherein a horizontal cross-section of the back wall panel is curved.

14. The ice/liquid dispensing bay of claim 1, wherein the drip tray defines a lower limit of a slot that accommodates the drip plate.

15. The ice/liquid dispensing bay of claim 1, wherein the drip tray is surmounted by a grid on which the drip plate is supported.

16. The ice/liquid dispensing bay of claim 1, wherein the drip tray is removable from the bay.

17. A domestic refrigeration device having an ice/liquid dispensing bay, the ice/liquid bay comprising:

a drip tray defining a lower end of the bay; and a drip plate covering the drip tray, the drip plate having an edge that has at least one locking recess into which a locking projection that is biased by a spring engages in a locked position for securing the drip plate with the drip tray; wherein the spring includes a fixed leg that is mounted to the drip tray for attachment of the spring to the drip tray; the drip tray comprises a push-in mount for the spring;

a lower end section of the bay has a recess that accommodates the drip tray and the push-in mount; and the push-in mount comprises two facing grooves into which the fixed leg of the spring is inserted.

18. An ice/liquid dispensing bay for a domestic refrigeration device, the ice/liquid dispensing bay comprising:

a drip tray defining a lower end of the bay;

a spring including a first leg that is removably mounted to the drip tray and a second leg that provides bias/tension in a direction substantially perpendicular to a plane created by the first leg;

a locking projection couple to the spring;

a drip plate detachably covering the drip tray, the drip plate including a circumferential edge with a locking recess; wherein the bias/tension of the second leg positions the locking projection into the locking recess when the drip plate covers the drip tray in an attached position, for securing the drip plate with the drip tray within the ice/liquid dispensing bay.

* * * * *